US006250426B1

(12) United States Patent
Lombard

(10) Patent No.: US 6,250,426 B1
(45) Date of Patent: Jun. 26, 2001

(54) DUAL-MAST SELF-ELEVATING PLATFORM CONSTRUCTION

(75) Inventor: Xavier Lombard, Pontoise (FR)

(73) Assignee: HEK Manufacturing B.V. (NL)

( * ) Notice: Subject to any disclaimer, the term of this patent is extended or adjusted under 35 U.S.C. 154(b) by 0 days.

(21) Appl. No.: 09/125,054

(22) PCT Filed: Feb. 4, 1997

(86) PCT No.: PCT/EP97/00483

§ 371 Date: Jul. 13, 1999

§ 102(e) Date: Jul. 13, 1999

(87) PCT Pub. No.: WO97/29040

PCT Pub. Date: Aug. 14, 1997

(30) Foreign Application Priority Data

Feb. 5, 1996 (EP) ..... 96 01362

(51) Int. Cl.[7] ..... G04G 1/20
(52) U.S. Cl. ..... 182/146
(58) Field of Search ..... 182/141, 146, 182/145, 82; 187/270, 352

(56) References Cited

U.S. PATENT DOCUMENTS 3,313,376 * 4/1967 Holland ..... 187/270
3,318,414 * 5/1967 Meek ..... 182/146
3,415,343 * 12/1968 Svensson ..... 187/352
4,171,033 * 10/1979 Rust ..... 182/145
4,293,054 * 10/1981 Pieri ..... 182/146
5,159,993 * 11/1992 St-Germain ..... 182/82
5,555,952 * 9/1996 van Mol ..... 182/141

FOREIGN PATENT DOCUMENTS

7412911 * 5/1976 (NL) ..... 182/141
2012091 * 7/1992 (WO) ..... 182/141
4005588 * 3/1994 (WO) ..... 182/141

* cited by examiner

*Primary Examiner*—Alvin Chin-Shue
(74) *Attorney, Agent, or Firm*—Locke Liddell & Sapp LLP

(57) ABSTRACT

A self-elevating platform construction consisting of first (3) and second (4) vertical masts each provided with a rack (13), first (14) and second (15) carriages movable along the first and second masts respectively, and each provided with a gear (26) rotated by a motor and meshing with the mast rack (13), as well as a support for a platform (16) borne on supporting shafts (32) of said first and second carriages (14, 15) and extending between said first and second masts (3, 4). The construction is characterized in that the platform (16) is rigid and in that the supports (32) of the first and second carriages (14, 15) comprise shafts (32) perpendicular to the rack (13) of the first and second masts (3, 4), respectively. Said construction is mainly suitable for building construction and renovation.

17 Claims, 6 Drawing Sheets

DUAL-MAST SELF-ELEVATING PLATFORM CONSTRUCTION

The invention concerns jack-up platform structures used for construction and exterior renovation and maintenance work on buildings, including in particular residential buildings, administrative or industrial buildings, but also, by extension, vessels either floating or in dry dock.

Known platform structures are for example described in the French patent published under number FR-A-2671336.

These structures include a first and second vertical mast each equipped with a rack. Pinions mounted on movable motorized carriages engage with the rack of each mast and drive a horizontal platform supported by the carriages in a vertical translation movement. The platform, and the personnel and tools it supports, can be raised or lowered at will with a view to carrying out precise work at an adequate height on a building.

Known platforms stretch between the masts and also extend on either side of them. They are composed of modular elements which, when assembled, form at least three distinct segments: one central segment and two side segments. The central segment stretches only between the masts, while the side segments extend beyond the masts. The side segments and the central segment are connected, at the height of each mast, to the carriages.

The connections between the segments and the carriages have at least a degree of rotational freedom, such that a slight inclination of one segment with respect to the horizontal is tolerated. In this way, segments are independent from each other such that a force applied to any one of them is transmitted not to another segment but only, in the form of a couple, to the carriage and, more precisely, to the masts via guide rollers. Rotation of the segments with respect to the masts is then used to create a complex mechanism that immobilises movement of the platform when the inclination becomes too great.

A structure such as this does however involve the construction of floating-plate carriages, in which pinions are attached to a plate floating in horizontal and vertical translation in the carriage. This plate, which supports the gear pinions, is held in a housing of the carriage by elastic means, usually springs. Forces transmitted by the segments to the carriages are then distributed evenly to four guide rollers arranged in pairs on either side of the carriage, one above the other on each side. This type of mechanism is complex and expensive.

In addition, robots carried by the platform are unable to move from one segment to the other but remain confined to one of them.

Considering the state of the art outlined above, one problem the invention proposes to solve is that of building a jack-up structure that overcomes the above-mentioned drawbacks at lesser cost, whereby the transmission of forces acting on the pinions engaged with the rack does not generate couples resulting in disturbance of the platform's translation movement.

According to the invention, the solution to this problem lies in a jack-up structure in which the platform stretching between the masts and possibly extending to either side of them is rigid, and whereby shafts supporting the platform are placed on the carriages perpendicular to the rack, i.e. with center lines orthogonal to and intersecting the rack.

The aim of the invention is therefore a jack-up platform structure comprising:

- a first and second vertical mast each equipped with a rack;
- a first and second mobile carriage running the length of the first and second masts respectively each containing a pinion driven in rotation by a motor and engaged with the mast rack, plus a support;
- a platform carried by the support of the first and second carriages stretching between the first and second masts, characterized in that the platform is rigid and in that the supports of the first and second carriages have shafts arranged perpendicular to the rack of the first and second masts respectively.

The rigidity of the platform, between the masts and on either side of them, enables robots carried by the platform to move over its entire length.

The following description, which is not exhaustive, will afford a better understanding of the practical aspects of the invention.

It should be read with reference to the annexed drawings, in which.

Figure 8A:
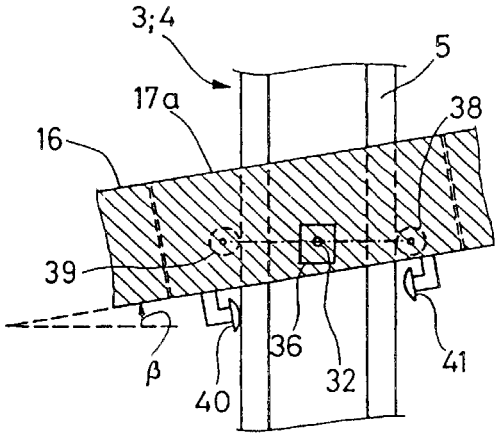
Figure 8B:
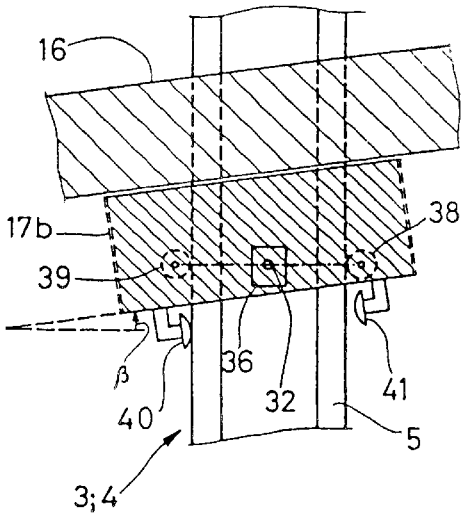
Figure 8C:
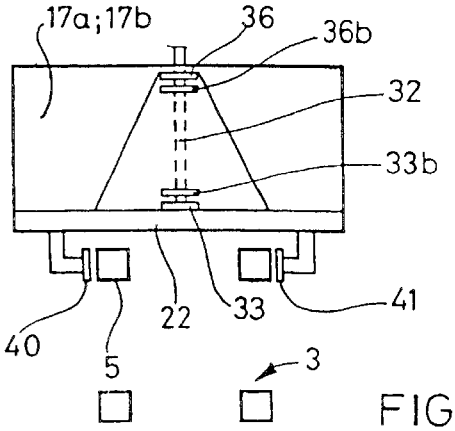
Figure 9:
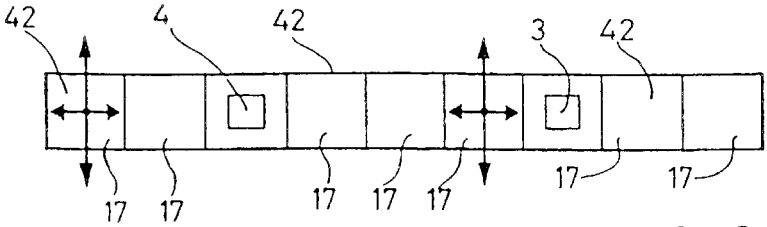
Figure 10:
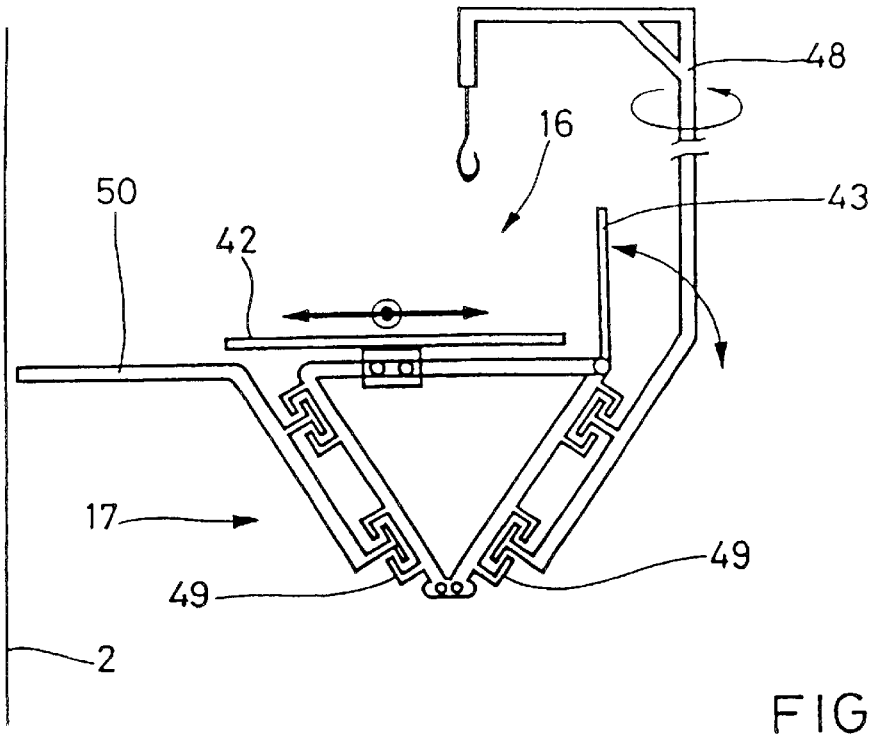
Figure 11:
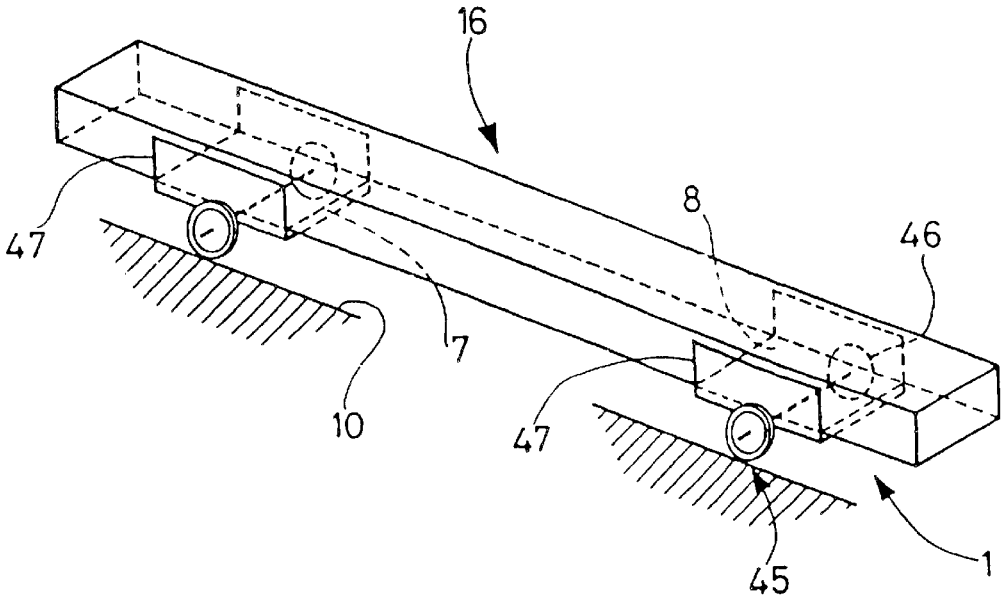

FIGS. 8*a*, 8*b* and 8*c* show schematically the immobilisation of a jack-up platform structure according to the invention;

FIGS. 9 and 10 show a top view and cross-section of the plate arrangement of a platform of a structure according to the invention; and FIG. 11 shows schematically a jack-up platform structure according to the invention in a lowered, so-called transport position.

Figure 1:
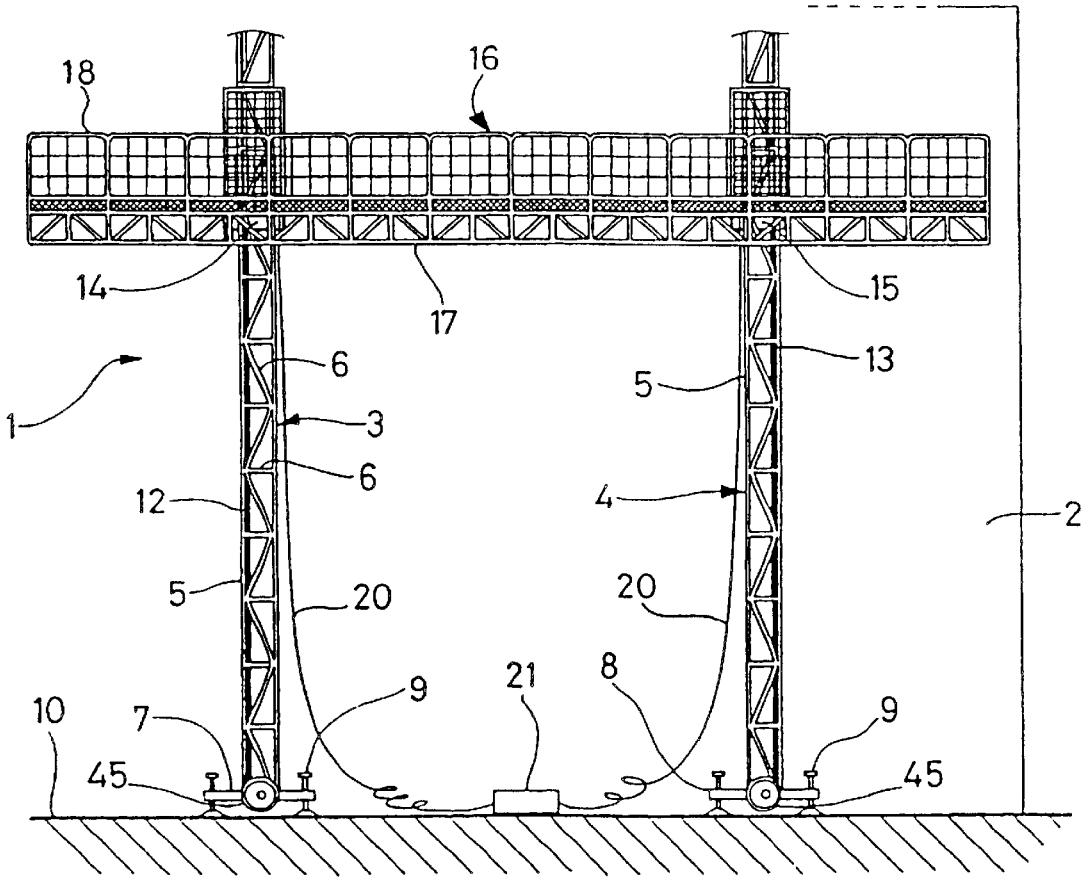
FIG. 1 shows a front view of a jack-up platform structure according to the invention.
Figure 2:
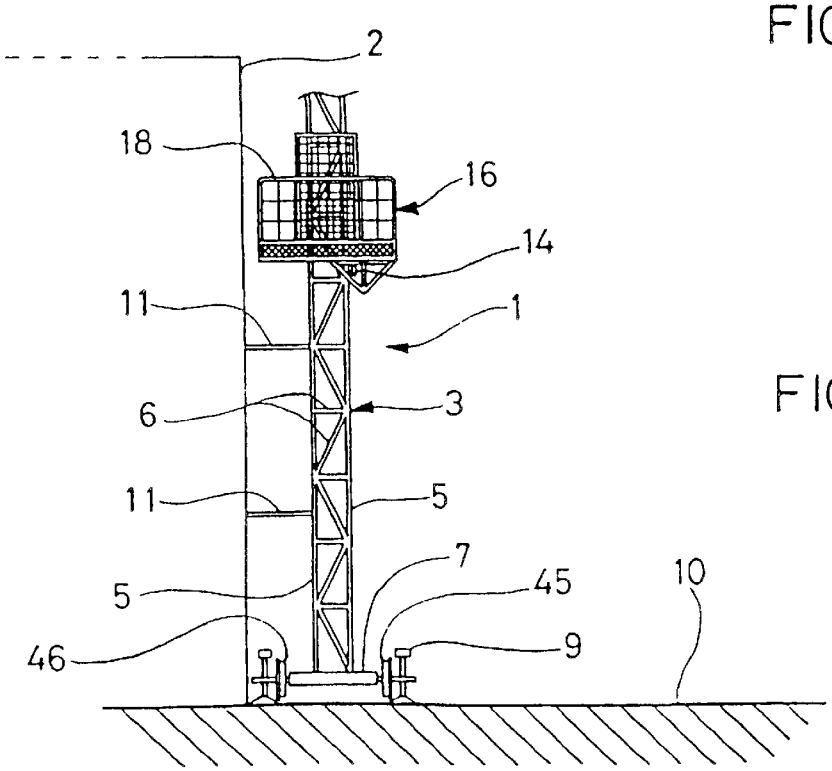
FIG. 2 shows a profile view of a jack-up platform structure according to the invention.

FIGS. 1 and 2 show a jack-up platform structure 1 according to the invention, placed in front of a facade 2 of a building under construction or being renovated.

This structure 1 has two vertical masts, a first mast 3 and a second mast 4, separated by a distance of for example ten meters. These masts 3, 4 are formed by metallic uprights 5 interconnected by oblique or horizontal bars 6. Depending on the number of these uprights 5 and their position, the masts 3, 4 present a rectangular, square or triangular cross-section. The following description is made with reference to a two-mast structure, however on account of the rigidity of the platform the details of the invention could easily be transposed to a structure with more than two masts if required.

The masts 3, 4 rest on support plates 7, 8 held horizontally by adjustable jacks 9 resting against the ground 10. These are ideally fixed to the facade 2 of the building at intervals, for example every five meters, by means of anchorages 11 of sufficient strength to resist the tensile and torsional forces exerted on the structure 1.

A rack, shown by a thick line in FIG. 1, runs the full height of each mast 3, 4. There is thus a first rack 12 on the mast 3 and a second rack 13 on the mast 4. The racks 12, 13 are welded and bolted to the masts 3, 4, for example to the bars 6.

Lastly, each mast 3, 4 supports a carriage. There is thus a first carriage 14 on the mast 3 and a second carriage 15 on the mast 4.

The carriages 14, 15 support a platform 16 which stretches between the masts 3, 4 and extends to either side of them. According to the invention, the platform 16 comprises elements 17 assembled so as to form a continuous rigid unit between the masts 3, 4, and extending to either side of them. Of course, extensions may be added to the sides of the platform 16, enabling its length to be increased appreciably, with a view in particular to working at low height.

The platform 16 has safety barriers 18 around its circumference, protecting people present on the platform and those below from falling objects.

The carriages 14, 15 are mobile in a vertical translation movement up and down the masts 3, 4. Thus, when the carriages 14, 15 rise, the platform 16 rises, and when the carriages 14, 15 descend, the platform 16 descends.

Figure 3:
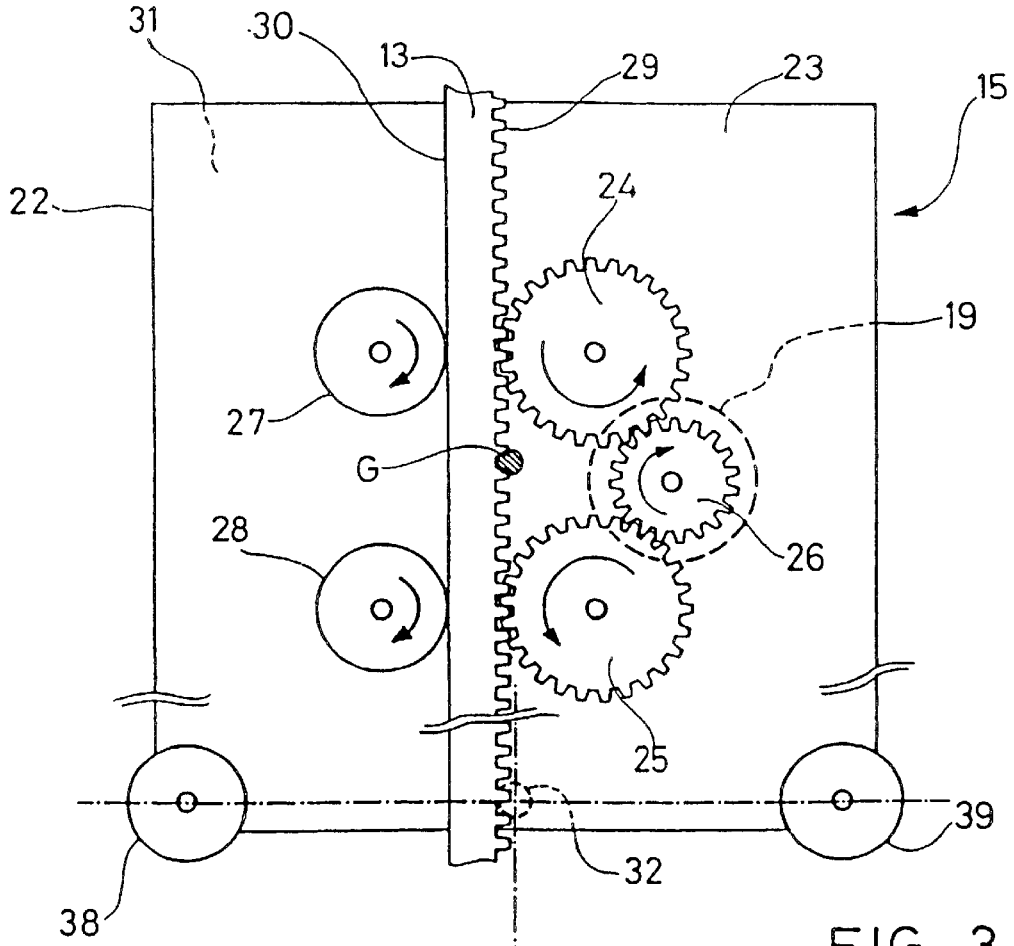
FIG. 3 shows in front view the layout of the different rollers and pinions of a carriage of a jack-up platform structure according to the invention.
Figure 4:
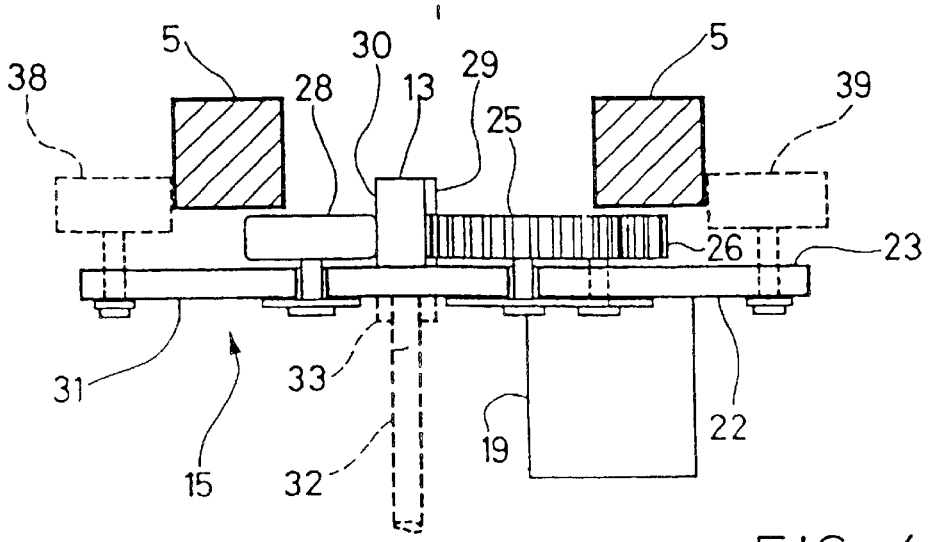
FIG. 4 shows a top view of a carriage of a jack-up platform structure according to the invention.

For this purpose, motors 19 shown only in FIGS. 3 and 4, supported by the carriages 14, 15, are connected by electrical cables 20 to a power source 21. The power-supply control for the motors 19 is preferably situated on the platform 16 so that the occupants can operate it themselves.

Figure 5:
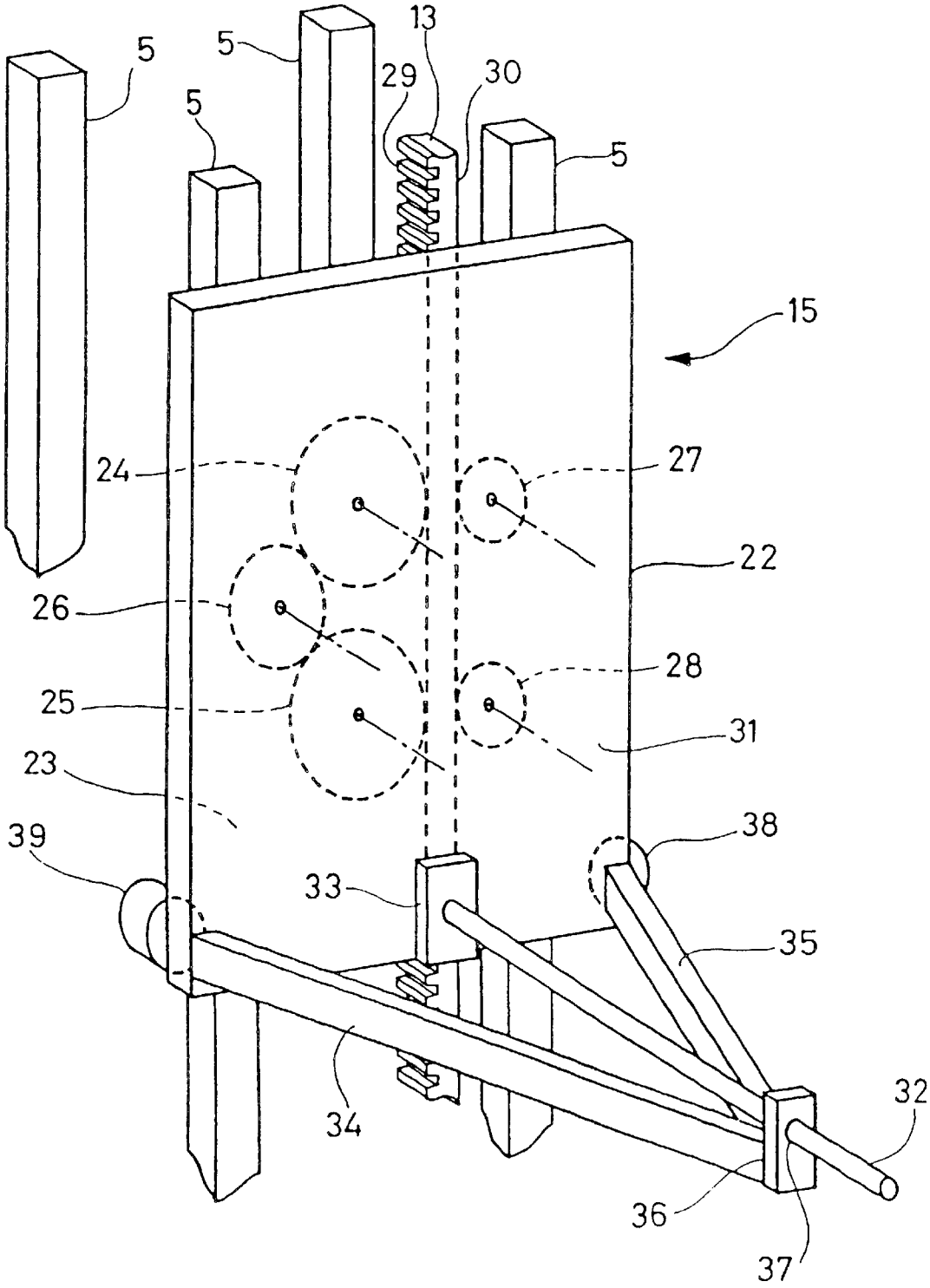
FIG. 5 shows a perspective view of a carriage of a jack-up platform structure according to the invention.

With reference to FIGS. 3, 4 and 5, the carriage 15 is shown with a metallic plate 22. This plate 22, or an arrangement of structural profiles constituting its main framework, supports on one of its surfaces 23 three toothed pinions: two driving pinions 24, 25 and one motor pinion 26. It also supports two presser rollers 27, 28. These pinions 24, 25, 26 and rollers 27, 28 are free to rotate on the plate 22 and their axes of rotation pass through it perpendicularly.

The motor pinion 26 is engaged with both driving pinions 24, 25 and the latter are themselves engaged with a toothed side 29 of the rack 13 of the mast 4. The pinion 26 is therefore considered as being engaged with the rack 13 indirectly.

The presser rollers 27, 28 press against a non-toothed side 30 of the rack 13 opposite its toothed side 29, directly opposite the driving pinions 24, 25.

Vertical translation of the carriage 15 is explained as follows. The electric motor 19 of the carriage 15 coupled to a reduction gear and supported by a surface 31 opposite the surface 23 of the plate 22 drives the motor pinion 26 in rotation. This rotation is conveyed to the driving pinions 24, 25 which move up and down the rack 13, resulting in the ascent or descent of the carriage 15, with the presser rollers 27, 28 restricting lateral escapement of the pinions 24, 25 outside the rack 13. This assembly results in the presence of a center G of traction of the carriage situated in the plane of the side 29 of the rack half-way between the gearing of the pinions 24, 25 on the rack 13. The assembly functions as if the carriage were being pulled by the center G.

Of course, a carriage 15 can be envisaged with a motor pinion 26 directly engaged with the rack 13. However, thanks to the presence of two driving pinions 24, 25 carefully positioned as indicated above, the couples exerted by the motor 19 on the motor pinion 26 in the driving pinions 24, 25 and on the rack 13 are also evenly distributed.

According to the invention, each carriage 14, 15 has an axial support. This axial support comprises a removable metallic shaft 32 housed, at one of its freely rotating ends, in a bearing 33. The bearing 33 is fixed to the bottom of the plate 22, on the side with the motor 19. It could nevertheless be fixed to the other side of the plate 22, since the shaft 32 does not come into contact with rack 13. The shaft 32 is perpendicular to the rack 13. The center of the bearing 33 is situated in the plane of the toothed side 29 of the rack 13 which also contains the center G. As shown in FIG. 5, the supporting shaft 32 is held, at another end, by another bearing 36. This other bearing 36 is secured by two horizontal bars 34, 35 welded at one of their ends to the plate 22 and attached at the other end to the bearing 36. The bearing 36 has a through hole 37 through which the supporting shaft 32 passes. The bars 34, 35 thus describe a triangle. A different structure can however be envisaged to support the bearing 36.

Each carriage 14, 15 has in addition a first and second guide roller 38, 39 free to rotate on the plate 22 about axes of rotation that intersect with it perpendicularly. These rollers 38, 39 are located in the bottom section of the plate 22. They are situated symmetrically on either side of the supporting shaft 32 of each carriage 14, 15, horizontally. They press against the vertical uprights 5 of the mast 4. The axes of the rollers 38, 39 and those of the shaft 32 are situated in a single plane represented by a horizontal axis.

In practice, and as illustrated more particularly in FIG. 8*a*, one element 17*a* of the platform 16 engages along the shaft 32 so that the element 17*a* conserves a degree of rotational mobility about the shaft 32. Therefore, the shafts 32 of the masts 3 and 4 allow an inclination, at least slight, of the platform 16. Other methods of realization can nevertheless be envisaged. In particular, in FIG. 8*b*, instead of an element 17*a* of the platform 16 engaging along the shaft 32, a caisson 17*b* can be used to support the platform 16. In this method of realization, the caisson 17*b* may or may not be rigidly attached to the platform 16, for example by welding. If the caisson 17*b* is not rigidly attached to the platform 16, the latter is also supported by the shaft 32 (as in FIG. 8*a*), and a clearance between the caisson 17*b* and the platform 16 can then exist. This clearance gives the structure according to the invention a degree of tolerance with respect to slight inclinations of the platform 16. Its usefulness will be seen below.

Figure 6:
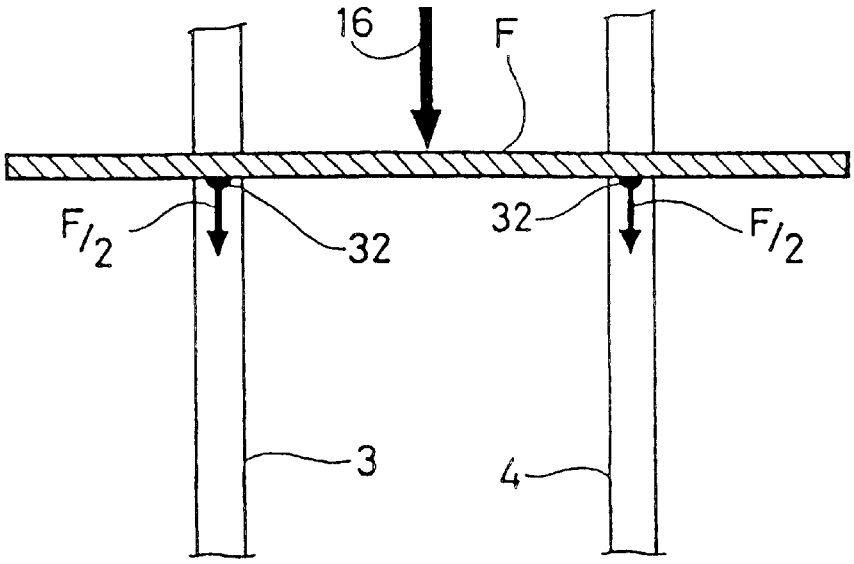
FIG. 6 illustrates schematically the distribution of forces applied to a platform of a structure according to the invention.

With regard to FIG. 6, if a force F is applied to the platform 16, because of the rigidity of the latter, this force F is transmitted to the supporting shafts 32, where it breaks down into vertical forces F/2 corresponding to one half of the force F applied. As the supporting shafts 32 are perpendicular to the racks 12, 13, the reactions R opposing the forces F/2 are also vertical and merge with both axes of traction of the platform 16 and, for this reason, with both racks 12, 13. Therefore, a force F applied to the platform 16 will not give rise to any couple on the carriage 14, 15 or the pinions 24, 25. The carriage 14, 15 remains aligned with the rack 12, 13. This is materialized by a vertical axis of symmetry, in FIG. 3, passing through the axis of the shaft 32 and through the center G.

As a result of the above, only one load sensor, for example a balance, carefully positioned with respect to each of the two supporting shafts 32, is required to measure the force F over the entire platform 16. In practice, a second load sensor is provided for safety reasons. In an example, a sensor such as this is mounted in the bearing 36 or even inside the shaft 32 at the place where the shaft rests in one of the bearings.

Figure 7:
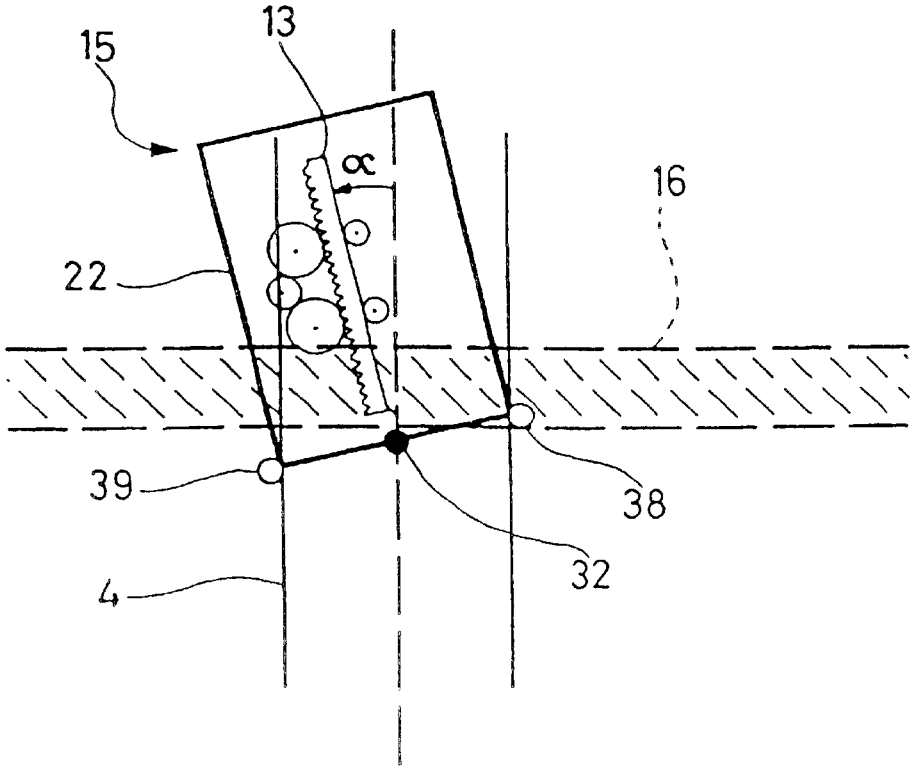
FIG. 7 shows schematically the exaggerated inclination of a carriage of a jack-up platform structure according to the invention.

In FIG. 7, the rack 13 does not describe a strictly vertical line, but presents an inclination ∞ with respect to the mast 4, normally of about 1%. This is due to the assembly tolerance of the rack in the masts. In this case the carriage 15, which has only two guide rollers 38, 39 aligned on either side of the supporting shaft and which, for this reason, is not guided or held in its upper section, pivots about the axis of the shaft 32 in such a way as to follow the inclination of the rack 13. The platform 16 nevertheless remains in a predominantly horizontal position. In a variant, the carriage is of the floating plate type, but there are still only two rollers 38, 39. In all cases, the known complex mechanisms supposed to take into account these defects in mast construction are avoided.

FIGS. 8*a* and 8*b* show a schematic representation of the platform 16 inclined at an angle β with respect to the horizontal. In one case (FIG. 8*a*), the element 17*a* of the platform 16 engages along the shaft 32. In another case (FIG. 8*b*) the caisson 17*b* engages along the shaft 32. This configuration is in practice accepted only if β is less than 1%. Between 1 and 2%, the motors 19 are used in order to regulate the inclination. After 2%, the motors 19 are switched off to allow adjustment, and when β attains 3%, vertical translation is blocked. For this purpose, according to the invention, braking stops or shoes 40, 41 are provided. In FIG. 8*c*, these braking shoes 40, 41 are shown rigidly attached to the element 17*a* of the platform 16 or caisson 17*b*, to which they are welded or bolted. For this purpose, they are mounted on brackets that are attached to the element 17*a* or 17*b*. These brackets project horizontally outside the plane of the plate 22, for example passing under this plate as shown in FIGS. 8*a* and 8*b*. The brackets are situated near the vertical uprights 5 of the masts 3, 4, so that when the platform 16 is horizontal, a clearance separates them from the uprights 5. This clearance is adjusted so that an inclination of 3% of the platform 16 places the stops 40, 41 in contact with the uprights 5 of the masts 3, 4. FIG. 8*c* shows additional bearings 33*b* and 36*b* rigidly attached to the element 17*a* or caisson 17*b* and mounted in the latter so that the shaft 32 can pass through them at the same time as the bearings 33 and 36.

FIGS. 9 and 10 show a schematic top view and crosssection respectively of the platform 16, constructed by rigid assembly of the elements 17. These elements 17, shown here with a triangular cross-section and an elongated form, each have in their upper part a plate 42 able to move transversely. They also have plates 43 that can be folded horizontally. The assembly of the plates 42, 43 constitutes the floor of the platform 16. According to one advantageous aspect of the invention, the plates 42 are able to slide transversely and along the platform 16. In addition, the plates 43 can slide longitudinally to good effect along the edges of the platform 16. Therefore, the platform has a degree of modularity allowing it to meet the dimensional requirements imposed by buildings. This modularity is noteworthy, given that the platform 16 is rigid and that for this reason the plates 43 can occupy any position along the said platform 16, since the carriages are not an obstacle to the mobility of the plates 43. In particular, these sliding plates can reach the ends of the overhanging segments.

In addition, FIG. 10 shows a schematic representation of a robot or a crane 48. This robot 48 is mobile. It can move along the entire length of the platform 16, for example with a sliding fixture within enclosure rails 49 rigidly attached to the platform 16. The rigidity and continuity of the platform 16 allows such movements, particularly beyond the masts 3, 4. As a result of the above, only one robot 48 is required per structure 1 according to the invention for loading or unloading purposes or to transfer materials to a particular place on the platform 16 between the masts 3, 4, or on either side of them. FIG. 10 also shows a plate 50 sliding longitudinally on the platform 16 on supporting rails 49 attached to the elements 17. The plate 50 makes it possible to approach the facade 2 as closely as possible. There is a plate 50 between the masts 3 and 4 and one on either side of each mast.

FIG. 11 shows a schematic representation of the jack-up platform structure 1 according to the invention in a lowered or transport position. In this position the platform 16 is held in containers 47 rigidly attached to supporting plates 7, 8. The jacks 9 are set in the up position. Therefore, one set of two wheels 45, 46 on each plate 7, 8 rests on the ground 10. The assembly thus described forms an adequate transport chassis. As the platform 16 is rigid, only two wheels are required per plate 7, 8 to transport the structure 1 according to the invention, instead of the four required for segmented platform structures according to the prior art. The axles of the plate wheels are aligned with the masts. For orientation, only one set of wheels needs to be adjustable. Therefore the structure 1 according to the invention is much more practical to manoeuvre than structures according to the prior art.

The solution of the invention thus described is therefore shown to be at the origin of many significant improvements which, in particular, have important repercussions in terms of the safety, strength and ease of use of jack-up platform structures.

What is claimed is:

1. A jack-up platform structure comprising:

a first and a second vertical mast wherein each mast is equipped with a rack;

a first and a second mobile carriage running the length of the first and second masts, respectively, wherein each mobile carriage comprises a pinion driven in rotation by a motor and engaged with the rack of the masts and a support;

a platform carried by the supports of the first and second carriages extending between the first and second masts, wherein the platform is rigid and wherein the supports of the first and second carriages comprise shafts rotatably attached in bearings of their respective carriage, and arranged perpendicular to the rack of the first and second masts, respectively.

2. The structure according to claim 1, further comprising a robot, wherein the platform extends to either side of the masts and wherein the robot is carried by the platform and is mobile along the platform between the masts and on either side of the masts.

3. The structure according to claim 1, wherein each carriage comprises a first and a second roller for guiding the carriage.

4. The structure according to claim 3, wherein each carriage comprises only two guide rollers.

5. The structure according to claim 3, wherein the first and second guide rollers are aligned horizontally on either side of the supporting shaft of the carriage.

6. The structure according to claim 1, wherein the shaft is a removable shaft for fixing an element of the platform to a carriage.

7. The structure according to claim 1, further comprising two braking stops rigidly attached to the platform.

8. The structure according to claim 1, further comprising guide rails which extend over the entire length of the masts.

9. The structure according to claim 2, wherein each carriage comprises a first and a second roller for guiding the carriage.

10. The structure according to claim 4 wherein the first and second guide rollers are aligned horizontally on either side of the supporting shaft of the carriage.

11. The structure according to claim 4, wherein the first and second guide rollers are aligned horizontally on either side of the supporting shaft of the carriage.

12. The structure according to claim 2, wherein the shaft is a removable shaft for fixing an element of the platform to a carriage.

13. The structure according to claim 3, wherein the shaft is a removable shaft for fixing an element of the platform to a carriage.

14. The structure according to claim 2, further comprising two braking stops rigidly attached to the platform.

15. The structure according to claim 3, further comprising two braking stops rigidly attached to the platform.

16. The structure according to claim 2, further comprising guide rails which extend over the entire length of the masts.

17. The structure according to claim 3, further comprising guide rails which extend over the entire length of the masts.

* * * * *